United States Patent [19]

Sotelo

[11] Patent Number: 4,877,648

[45] Date of Patent: Oct. 31, 1989

[54] KIT AND METHOD FOR USING KIT TO RE-FINISH PLASTERED CONSTRUCTIONS

[76] Inventor: Santiago Sotelo, 12105 S. Hamilton, Alsip, Ill. 60658

[21] Appl. No.: 184,766

[22] Filed: Apr. 22, 1988

[51] Int. Cl.[4] ..... B32B 35/00

[52] U.S. Cl. ..... 427/140; 15/235.6; 15/235.8; 52/514; 264/36; 427/403

[58] Field of Search ..... 52/255-257, 52/514; 427/140, 402, 403; 15/235.6, 235.8; 264/36

[56] References Cited

U.S. PATENT DOCUMENTS

| | | | |
|---|---|---|---|
| 2,214,999 | 9/1940 | Hullinger | 72/329 X |
| 2,526,401 | 10/1950 | Oscar | 15/235.8 |
| 3,345,789 | 10/1967 | Tatum | 52/255 X |
| 4,311,656 | 1/1982 | Spriggs | 427/140 X |
| 4,463,644 | 8/1984 | Ferdinand et al. | 269/47 X |

*Primary Examiner*—Michael Lusignan
*Attorney, Agent, or Firm*—Bernard L. Kleinke

[57] ABSTRACT

The method of re-finishing an uneven opened-angle construction joint of a ceiling or the like, includes an inventive kit including a line marking device to impart two straight lines, one at the uneven line of the open angle construction, and the second parallel to the first and at a distance equal to the width of a blade of a trowel of the kit to be used in applying a refinishing material to the ceiling. Then one or more elongated guides of the kit are temporarily attached end-to-end to the ceiling along the second line. After attaching the guides, a refinishing material is applied to the ceiling at the uneven joint, by drawing the trowel blade positioned with one of its corner edges against the marginal edge of the guide and its other corner edge against the open-angle corner.

11 Claims, 2 Drawing Sheets

KIT AND METHOD FOR USING KIT TO RE-FINISH PLASTERED CONSTRUCTIONS

DESCRIPTION

TECHNICAL FIELD

The present invention relates in general to a kit and method for using the kit to re-finish plastered surfaces, and it more particularly relates to a kit and method for using the kit to re-finish the joint of an opened-angle construction, such as a cathedral ceiling joint.

BACKGROUND ART

There have been many different types and kinds of plastering re-finishing devices and techniques. For example, reference may be made to the following U.S. Pat. Nos. 1,179,170; 1,673,940; 1,673,941; 2,110,401; 2,214,999; 2,526,401; and 4,463,644.

While such prior known devices may have been successful for some applications, it has been difficult, if not impossible, to re-finish an opened angle corner of a ceiling or other architectural construction. In this regard, for example, in a cathedral ceiling opened angle joint, it is very difficult to create and form a straight line at the corner defined by the intersection of contiguous ceiling surfaces. Therefore, it is frequently necessary to re-form the opened corner in an attempt to provide a straight-line joint.

Various different trowels, and other devices and tools, are used in an attempt to re-surface the joints manually to form a straight line. Even though, the line may be somewhat improved after time consuming and costly efforts, finished joint have not been entirely satisfactory.

Therefore, it would be highly desirable to have a new and improved kit and method for using a kit to refinish the joint of an opened-angle corner construction, to provide a straight-line construction. Such a kit should be relatively inexpensive to manufacture, and should be used in a convenient manner. In this regard, it would be highly desirable to have a method which is fast and efficient to execute, so as to minimize the time and effort involved.

DISCLOSURE OF INVENTION

Therefore, it is the principal object of the present invention to provide a new and improved kit and method of using it to re-finish an opened-angle plastered joint in a convenient and efficient manner.

Another object of the present invention is to provide a new and improved kit for facilitating the re-finishing of the open-angle plastered joint, which kit is relatively inexpensive to manufacture and relatively convenient to use.

Briefly, the above and further objects of the present invention are realized by providing a method to re-finish a plastered opened-angle joint construction, and includes a kit to help facilitate the operation.

The kit and method of using it includes a chalk line marking device for applying two straight-chalk lines on the construction surface, first over the uneven opened-angled joint and second at a predetermined distance from the opened angle joint with reference to the first chalk line equal to the width of a trowel or other tool to be used for applying plaster or other re-finishing material to the opened-angle joint construction. A set of elongated guides adapted to be attached to the ceiling at the predetermined distance, end-to-end along the second chalk line. Pins for attaching the elongated guides to the ceiling and a trowel tool with a thin flat blade of rectangular shape for applying the plaster or refinishing material. The method then includes applying a first straight-chalk line generally over the uneven open-dangle joint, applying a second straight-chalk line on the construction surface with reference to the first chalk line at a predetermined distance from the first chalk line equal to the blade width of the tool for applying the plaster or refinishing material; attaching one or more elongated guides to the construction surface, end-to-end, along the second applied chalk-line; and applying the plaster or re-finishing material by spreading the material on the construction surface and along the opened-angle joint with a trowel by positioning the trowel so that one corner of its blade edge is brought into abutting contact with the marginal edge of the guide laid contiguous to the second applied chalk line, and the opposite corner of the blade edge held in abutting contact with the corner joint of the opened-angle construction while drawing the trowel along the guide, whereby the desired straight-line joint is formed at the opened-angle construction joint.

BRIEF DESCRIPTION OF DRAWINGS

The above mentioned and other objects and features of this invention and the manner of attaining them will become apparent, and the invention itself will be best understood by reference to the following description of an embodiment of the invention in conjunction with the accompanying drawings, wherein.

BEST MODE FOR CARRYING OUT THE INVENTION

Figure 1:
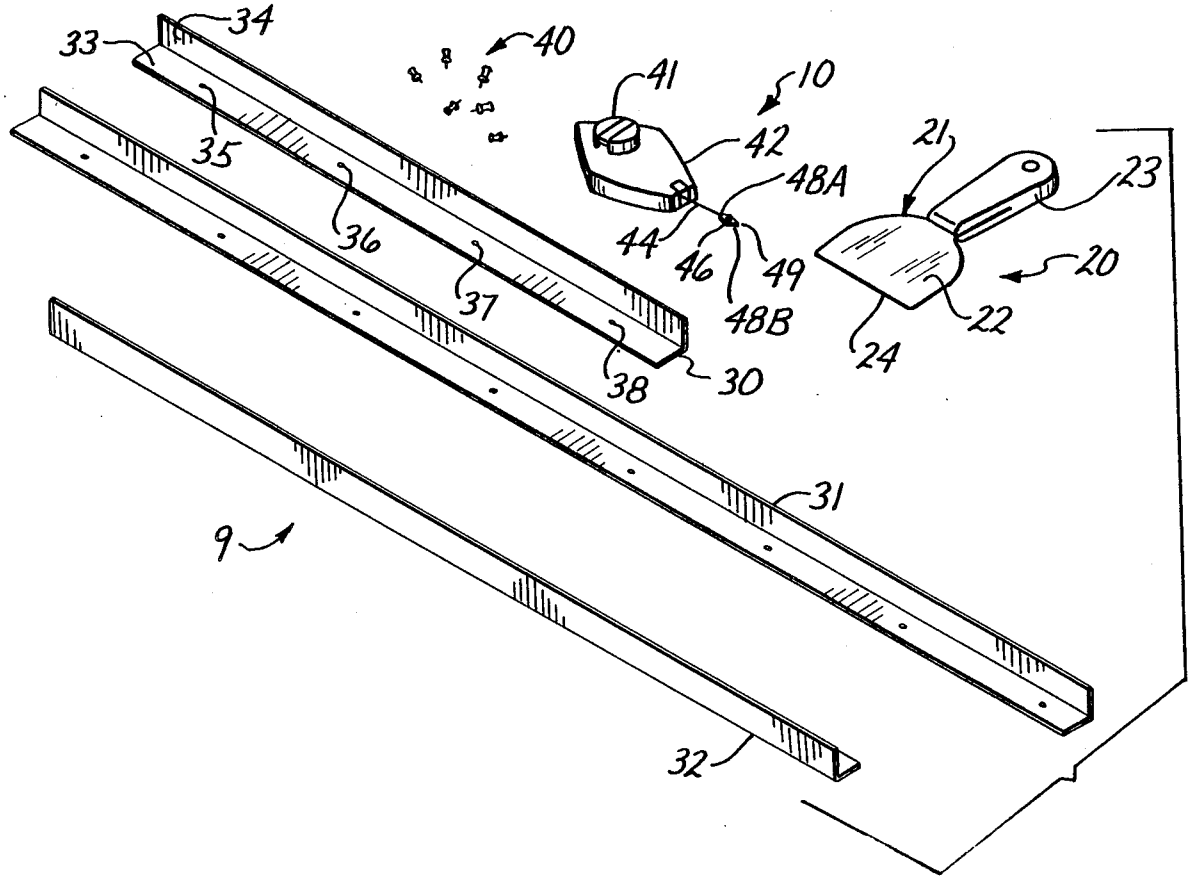
FIG. 1 is a pictorial view, illustrating operative elements of the open-angle joint construction kit, which is constructed in accordance with the present invention.

Referring now to the drawings, and more particularly to FIG. 1 thereof, there is shown an opened-angle joint reconstruction kit 9, which is constructed in accordance with the present invention. The kit 9 is used according to the method of the present invention to re-finish an opened-angle joint, indicated at 5 in FIGS. 2 and 3, as defined by an intersection between a pair of contiguous ceiling surfaces 13 and 14 of a corner generally indicated at 11. Such a ceiling corner may be the peak of a cathedral ceiling, but it may also be other joints or corners as well.

The kit 9 generally comprises a chalk line marking device 10, a blade tool trowel 20, a plurality of guides 30, 31 and 32, and a plurality of tacking pins generally indicated at 40. The kit 9 is utilized in refinishing the uneven open-angle joint 5 so that it will be corrected to be a straight line. The method of constructing the straight line joint with the kit 9 will hereinafter be described in greater detail.

Consider now the chalk line marking device 10 in greater detail with reference to FIG. 1, the chalk line marking device, of standard known construction, includes a housing 42 for retaining a winding reel (not shown) and chalk dust (not shown), a string 44 which is coated with chalk dust as it is drawn out of the housing 42, a bob 46 affixed at one of its ends 48A to the string 44 and having a pointed tip 49 at its opposite end 48B for fastening the bob 46 by the tip 49 to a construction surface corner 60, and a winding knob 41 for rewinding the string 16 back into the housing 42 thereby recoating the string with chalk dust.

Considering now guides 30, 31, and 32. Each one of the guides 30, 31, and 32 are similar to one another with the exception of their length and only guide 30 will now be described.

Referring to FIG. 1, the guide 30 is generally an L-shaped channel and is constructed of a suitable light weight thermoplastic material and includes an elongated member 33 and an integrally formed projecting member 34 which projects upwardly to member 33. Members 33 and 34 are of equal width and have a uniform cross section. Member 33 has a plurality of equally spaced holes 35, 36, 37, and 38 adapted to receive mounting pins generally indicated at 40 in FIG. 1.

Figure 4:
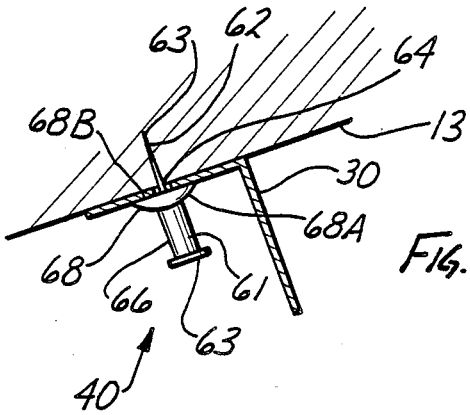
FIG. 4 is a sectional view of the guide of FIG. 3 taken approximately on line 4—4 thereof.

Considering now the mounting pins generally shown at 40. Each pin is similar and only pin 40 will now be described. Referring to FIG. 4, the pin 40 includes a straight shaft 62 with a pointed tip 63 at one end of the shaft 62 for embedding the pin 40 in a construction surface such as ceiling surface 13. The opposite end 64 of the shaft terminates in a pin head 66. Pin head 66 of unitary construction includes a base 68 having a generally domed shaped flat cylindrical base 68B, an integrally formed cylindrical shaft 61 projecting upwardly generally from the top of the base 68 and terminating in a circular lip 63 having substantially the same circumference as the base 68B.

Figure 2:
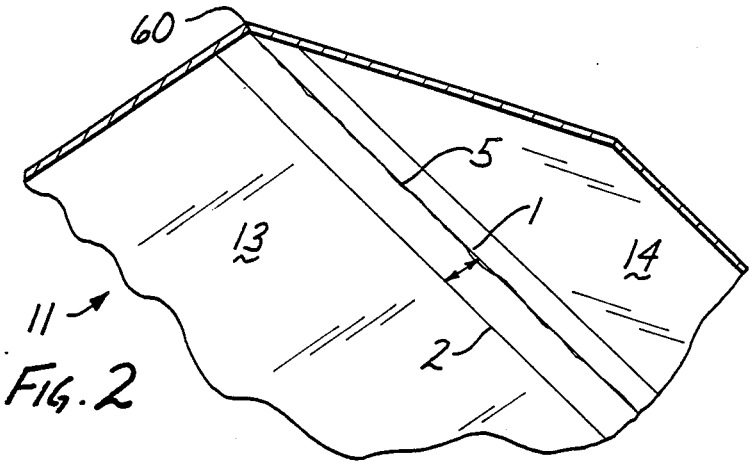
FIG. 2 is a fragmentary pictorial view, illustrating imparted chalk lines and an uneven opened-angle joint of a ceiling as an initial step of the refinishing method of the present invention.
Figure 3:
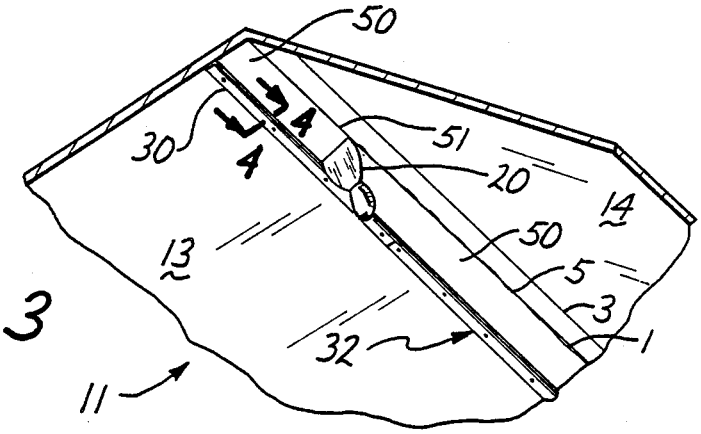
FIG. 3 is a fragmentary pictorial view, illustrating positioned guides and a trowel in an intermediate step of the process of refinishing the open-angle joint surface.

Consider now the use of the kit in greater detail with reference to FIGS. 2 through 4.

As indicated in FIGS. 2 through 4, a pair of parallel chalk lines 1 and 2 are initially imparted to the construction surface 13 with the chalk line marking device 10. The inventive method is initiated by making a first chalk line 1, which is imparted along the uneven opened angle joint 5 that is to be refinished by inserting the tip 49 of the bob 46 into the construction corner 60, withdrawing the string 44 from the housing 42 of the marking device 10, lifting the string vertically from the ceiling surface 13, and releasing the string so that it snaps back and comes into temporary contact with the ceiling surface 13, thereby imparting chalk dust to ceiling surface in the form of a straight line.

After the first chalk line 1 has been imparted to the construction surface 13, a second chalk line 2 is imparted to the ceiling 13 in the same manner and parallel to the first chalk line 1 and at a distance from the first chalk line 1 substantially equal to the trowel blade width 24 of the trowel 20, which will be utilized subsequently to apply a quantity of refinishing material 50. The word "trowel" as used in the specification means any flat blade tool or the like, utilized to apply the plaster or refinishing material to construction surfaces.

A guide 30 composed of any suitable, rigid lightweight material is then temporarily affixed to the ceiling 13 with one end of its marginal edge laying along the second chalk line 2. As illustrated in FIGS. 3 and 4 guide 30 is affixed to the ceiling by inserting pins 40 through spaced holes 35–38 in the guide 30. Additional guides 31 and 32 may be affixed end-to-end with refeence to guide 30 in a like manner to enable the positioning of guides along the entire ceiling 13 surface adjacent to the uneven opened-angle joint As illustrated in FIG. 1 a plurality of guides of varying lengths are provided in the kit to facilitate and enable corner joint constructions of varying lengths to be refinished.

In this manner, and as illustrated in FIG. 3, the refinishing material 50, which is any suitable material, such as Durabond 20, can then be applied by spreading the material on the ceiling surface 13 along the area between the guides and chalk line 1 by positioning the tool 20 so that one corner of its blade edge is brought into abutting contact with the marginal edge of the guides laid contiguous to the applied chalk line 2 while the opposite corner of the blade is held in abutting contact with chalk line 1 imparted along the uneven opened-angle joint 5 whereby the desired straight line joint is formed at the opened-angle construction joint 5 as the trowel 20 is drawn along the ceiling 13 between these references.

In applying the plaster material the craftsman's shell is utilized to assure that the quantity of material applied is not too much to assure a smooth even joint is formed.

After the coating is allowed to dry, a second coating may then be applied. Once the refinishing coating is applied, the temporarily affixed guides are removed leaving a desired smooth straight line 51 (FIG. 3).

Thereafter, the process may be repeated, if desired, along the contiguous ceiling 14 between the line 51 and the chalk line 3 if too much plaster material was initially utilized during the previous process.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A method of refinishing an irregular, uneven joint of an open-angle construction to form a substantially straight-line, which comprises:

applying a coating of marking material over the uneven joint, said coating being configured in a first thin straight line;

subsequently applying a coating of marking material configured in a second straight line parallel to the first line at a distance substantially equal to the width of the blade of a tool;

attaching temporarily to the construction surface, guide means having a straight-line edge superimposed in alignment with the second line;

applying with the tool blade to the construction between the guide edge and the uneven open angle a coating of a refinishing material; and removing the guide, whereby the uneven open-angle is replaced by a straight line joint.

2. A method of refinishing the joint of an open angle, as recited in claim 1, wherein said guide means includes a plurality of elongated guides, and said attaching includes positioning the guides end-to-end to the surface with their edge portion superimposed in alignment with the chalk line.

3. A method of refinishing the joint of an open angle, as recited in claim 1, wherein tool for applying the refinishing material is a trowel.

4. A method as recited in claim 3, wherein the applying of the refinishing material includes positioning the trowel so that one corner of its blade edge is brought in abutting contact with the guide edge, and the opposite corner of the blade edge is brought in abutting contact with the corner joint of the open angle at the first line to serve as a visual indicator as to where the desired straight-line joint is to formed, as the trowel is drawn along the surface spreading the re-finishing material.

5. A kit for refinishing the uneven, irregular joint of open angle constructions to provide a straight line joint thereat, which comprises:

means for applying a line on a construction surface parallel to the edge of the joint of an open angle construction;

a group of elongated guides, each one of said giudes being of different lengths and having a substantially straight edge, said guides adapted to be attached to a construction surface abutted end-to-end so that the elongated edges are superimposed in alignment with a line coated on the construction surface spaced from the straight line joint to be formed; and means including a blade having a substantially straight edge for serving as an indicator of the distance between the straight line and the straight line joint to be formed, and for applying refinishing material to the construction between the guides and the irregular joint by moving said blade in a continuous motion with one of its edges abutting the guides, whereby the re-finishing material forms a straight line at the joint of the open angle construction as it is uniformly spread on the construction surface.

6. A kit as recited in claim 5, wherein said means for applying refinishing material is in the form of a trowel whose blade width equals the perpendicular distance between the joint edge of the open angle construction and the coated line on the construction surface.

7. A kit as recited in claim 6, in which the refinishing material includes plaster material.

8. A method of refinishing an irregular, uneven joint of an open-angle construction as recited in claim 1, wherein applying the marking material over the uneven joint comprises:

positioning a string coated with chalk over the uneven joint;

raising the string upwardly and perpendicularly from the uneven joint;

releasing the string so to manually snap the string against surface of the uneven joint, whereby a coating of chalk configured in a first thin straight line is applied over the uneven joint.

9. A method of refinishing an irregular, uneven joint of an open-angle construction as recited in claim 1, wherein applying the marking material configured in a second straight line parallel to the first line at a distance substantially equal to the width of the blade of a tool comprises:

positioning a tool blade so that one corner of its blade edge is brought into abutting perpendicular contact with the corner joint of the open angle at the coating configured in a first thin line;

positioning a string coated with chalk against the opposite corner of the blade edge held in abutting contact with construction surface;

raising the string upwardly and perpendicularly from the construction surface; and releasing the string so to manually snap the string against the construction surface; whereby a coating of chalk configured in a second thin straight line is applied parallel to the coating configured in a first thin line at a distance substantially equal to the width of the blade of the tool.

10. A method of applying a coating of chalk configured in a first straight line as recited in claim 8, wherein positioning a string comprises:

inserting a pointed bob attachment to said string in the opened corner of the open-angle construction.

11. A method of applying a coating of chalk configured in a second straight line as recited in claim 9 wherein positioning a string comprises:

inserting a pointed bob attached to said string in the construction surface adjacent to the blade edge held in abutting contact with said construction surface.

* * * * *

UNITED STATES PATENT AND TRADEMARK OFFICE

CERTIFICATE OF CORRECTION

PATENT NO. : 4,877,648

DATED : October 31, 1989

INVENTOR(S) : Santiago Sotelo

It is certified that error appears in the above-identified patent and that said Letters Patent is hereby corrected as shown below:

Column 2, line 5, delete "open-dangle", and substitute therefor --opened angle--.

Column 4, lines 2 and 3, delete "re-feence", and substitute therefor --reference--.

Column 4, line 5, after "joint", insert --.--.

Column 5, line 8, before "formed", insert --be--.

Column 5, line 17, delete "giudes", and substitute therefor --guides--.

Signed and Sealed this

Fourteenth Day of May, 1991

*Attest:*

*Attesting Officer*

HARRY F. MANBECK, JR.

*Commissioner of Patents and Trademarks*